US006889016B2

(12) United States Patent
Kyung

(10) Patent No.: US 6,889,016 B2
(45) Date of Patent: May 3, 2005

(54) IMAGE FORMING APPARATUS HAVING SURFACE POTENTIAL MEASURING UNIT AND METHOD OF CONTROLLING DEVELOPMENT VOLTAGE UTILIZING THE SAME

(75) Inventor: Myung-ho Kyung, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/459,446

(22) Filed: Jun. 12, 2003

(65) Prior Publication Data

US 2004/0052540 A1 Mar. 18, 2004

(30) Foreign Application Priority Data

Jul. 24, 2002 (KR) ..... 10-2002-0043622

(51) Int. Cl.[7] ..... G03G 15/06
(52) U.S. Cl. ..... 399/55
(58) Field of Search ..... 399/53, 55, 56, 399/270, 285; 347/140

(56) References Cited

U.S. PATENT DOCUMENTS 4,870,460 A * 9/1989 Harada et al. ..... 399/55 X
5,285,241 A * 2/1994 Scheuer ..... 399/55
5,774,762 A * 6/1998 Takemoto et al. ..... 399/55 X
6,061,534 A * 5/2000 Okada et al. ..... 399/55 X
6,134,395 A * 10/2000 Sasaki et al. ..... 399/53 X
6,538,678 B2 * 3/2003 Nakase et al. ..... 347/140 X

FOREIGN PATENT DOCUMENTS

KR 1989-23468 12/1989

* cited by examiner

*Primary Examiner*—Sandra L. Brase
(74) *Attorney, Agent, or Firm*—Staas & Halsey LLP

(57) ABSTRACT

An image forming apparatus and a method of controlling a development voltage include a photosensitive body, a charger which charges the photosensitive body, a laser scanning unit (LSU) which forms an electrostatic latent image by radiating light onto the photosensitive body, a developing unit which develops the electrostatic latent image by supplying a developing agent to the photosensitive body to form an image, a transfer unit which transfers the developed image onto a sheet of paper, a surface potential measuring unit disposed on the surface of the photosensitive body between the developing unit and the transfer unit to measure a surface potential of the photosensitive body, a comparator which compares the surface potential of the photosensitive body before a development voltage is supplied to the developing unit, with the surface potential of the photosensitive body after the development voltage is supplied to the developing unit, to calculate a deviation, and a controller which sets a new development voltage of the developing unit and controls the developing unit if the deviation is larger than a reference value.

22 Claims, 5 Drawing Sheets

IMAGE FORMING APPARATUS HAVING SURFACE POTENTIAL MEASURING UNIT AND METHOD OF CONTROLLING DEVELOPMENT VOLTAGE UTILIZING THE SAME

CROSS-REFERENCE TO RELATED APPLICATIONS

This application claims the priority of Korean Patent Application No. 2002-43622, filed on Jul. 24, 2002, in the Korean Intellectual Property Office, the disclosure of which is incorporated herein in its entirety by reference.

BACKGROUND OF THE INVENTION

1. Field of the Invention

The present invention relates to an image forming apparatus, and more particularly, to an image forming apparatus having a development voltage controlling unit.

2. Description of the Related Art

FIG. 1 schematically shows a structure of a conventional image forming apparatus. Referring to FIG. 1, the conventional image forming apparatus includes a photosensitive drum 10, a laser scanning unit (LSU) 11 which forms an electrostatic latent image by radiating light onto the photosensitive drum 10, developing rollers 13*a*, 13*b*, 13*c*, and 13*d* which develop the electrostatic latent image by supplying a developing agent to the photosensitive drum 10, a first transfer roller 17 which transfers the image developed by the developing rollers 13*a*, 13*b*, 13*c*, and 13*d* onto an intermediate transfer belt 15, a second transfer roller 19 which transfers the image of the intermediate transfer belt 15 onto a sheet of paper S, and a fusing roller 21 which fixes the image on the paper S by heating and pressurizing the image. Developing agents having four colors, such as yellow (Y), cyan (C), magenta (M), and black (K), are supplied to the developing rollers 13*a*, 13*b*, 13*c*, and 13*d*, respectively.

Here, a gap ring 12 is inserted around the developing rollers 13*a*, 13*b*, 13*c*, and 13*d*, such that surfaces of the developing rollers 13*a*, 13*b*, 13*c*, and 13*d* do not contact the photosensitive drum 10 and are spaced-apart by a gap formed between the surfaces of the developing rollers 13*a*, 13*b*, 13*c*, and 13*d* and the photosensitive drum 10. The conventional image forming apparatus includes a turret 14, which rotates each of the developing rollers 13*a*, 13*b*, 13*c*, and 13*d* in response to an input signal.

In the conventional image forming apparatus, in order to print the image on the paper S, the photosensitive drum 10 is charged by a charger (not shown), the light is radiated onto the photosensitive drum 10 by the LSU 11 to reduce a predetermined electric potential of the photosensitive drum 10, thereby forming the electrostatic latent image, while the developing rollers 13*a*, 13*b*, 13*c*, and 13*d* sequentially correspond to the photosensitive drum 10, non-contact development is performed on the photosensitive drum 10 by the gap formed by the gap ring 12, thereby developing the electrostatic latent image. The developed image is transferred onto the intermediate transfer belt 15 by the first transfer roller 17, and the image on the intermediate transfer belt 15 is transferred onto the paper S by the second transfer roller 19. The image on the transferred paper S is fixed on the paper S by the fusing unit 21.

In the conventional image forming apparatus, in a development operation, a direct current (DC) development voltage and an alternating current (AC) development voltage overlap to be applied to the developing rollers 13*a*, 13*b*, 13*c*, and 13*d*, thereby forming the developed image on a surface of the photosensitive drum 10. However, when the developing rollers 13*a*, 13*b*, 13*c*, and 13*d* are used for a long time, the gap ring 12 is worn down, such that the gap between the surface of the photosensitive drum 10 and the surfaces of the developing rollers 13*a*, 13*b*, 13*c*, and 13*d* is reduced. Thus, a development electric field formed on the photosensitive drum 10 and the surfaces of the developing rollers 13*a*, 13*b*, 13*c*, and 13*d* is increased. In this case, the overlapped development voltage of the DC and AC development voltages is excessively applied to the developing rollers 13*a*, 13*b*, 13*c*, and 13*d*. Thus, a leakage of the development voltage occurs, and spots occur in the image, or image concentration is excessively increased.

SUMMARY OF THE INVENTION

The present invention provides an image forming apparatus which can control a development voltage by detecting a leakage of the development voltage, thereby supplying a stable development voltage and providing a good image quality.

Additional aspects and advantages of the invention will be set forth in part in the description which follows and, in part, will be obvious from the description, or may be learned by practice of the invention.

According to an aspect of the present invention, an image forming apparatus includes a photosensitive body, a charger which charges the photosensitive body, a laser scanning unit (LSU) which forms an electrostatic latent image by radiating light onto the photosensitive body, a developing unit which develops the electrostatic latent image by supplying a developing agent to the photosensitive body to form an image, a transfer unit which transfers the developed image onto a sheet of paper, a surface potential measuring unit disposed on a surface of the photosensitive body between the developing unit and the transfer unit to measure a surface potential of the photosensitive body passing the developing unit, a comparator which compares the surface potential of the photosensitive body before a development voltage is applied to the developing unit, with a second surface potential of the photosensitive body after the development voltage is applied to the developing unit and calculates a deviation between the surface potential and the second potential, and a controller which sets a new development voltage of the developing unit and controls the developing unit if the deviation is larger than a reference value.

According to another aspect of the present invention, the developing unit includes a developing roller which supplies a developing agent to the photosensitive body, and a gap ring which is inserted around the developing roller so that a predetermined gap between the developing roller and the surface of the photosensitive body is maintained.

According to another aspect of the present invention, the reference value is about 80–100 V.

According to another aspect of the present invention, a method of controlling a development voltage applied to a developing unit of an image forming apparatus includes measuring a first surface potential of the photosensitive body before the development voltage is supplied to the developing unit, measuring a second surface potential of the photosensitive body after the development voltage is supplied to the developing unit, and if a deviation between the first surface potential and the second surface potential is larger than a reference value, controlling the developing unit by setting a new development voltage, and if the deviation is not larger than the reference value, repeating the measuring of the first surface potential.

According to another aspect of the present invention, the controlling the developing unit includes setting the new development voltage to be smaller than the development voltage supplied to the developing unit in measuring the second surface potential, that is, smaller than the deviation.

According to another aspect of the present invention, the developing unit includes a developing roller which supplies a developing agent to the photosensitive body, and a gap ring which is inserted around the developing roller so that a predetermined gap between the developing roller and the surface of the photosensitive body is maintained.

According to another aspect of the present invention, the reference value is about 80–100 V.

According to another aspect of the present invention, a leakage of the development voltage, occurring when a gap between a developing roller and a photosensitive body is reduced, is detected from a surface potential of the photosensitive body, thereby effectively controlling the development voltage.

According to another aspect of the present invention, an apparatus for controlling a development voltage supplied to a developing unit in an image forming apparatus includes a surface measuring unit measuring a first surface potential of the photosensitive body before the development voltage is supplied to the developing unit, and a second surface potential of the photosensitive body after the development voltage is supplied to the developing unit, and a development voltage adjuster generating the development voltage according to the first and second potentials.

According to another aspect of the present invention, a method of controlling a development voltage supplied to a developing unit in an image forming apparatus includes measuring a first surface potential of the photosensitive body before the development voltage is supplied to the developing unit, and a second surface potential of the photosensitive body after the development voltage is supplied to the developing unit, and generating the development voltage according to the first and second potentials.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
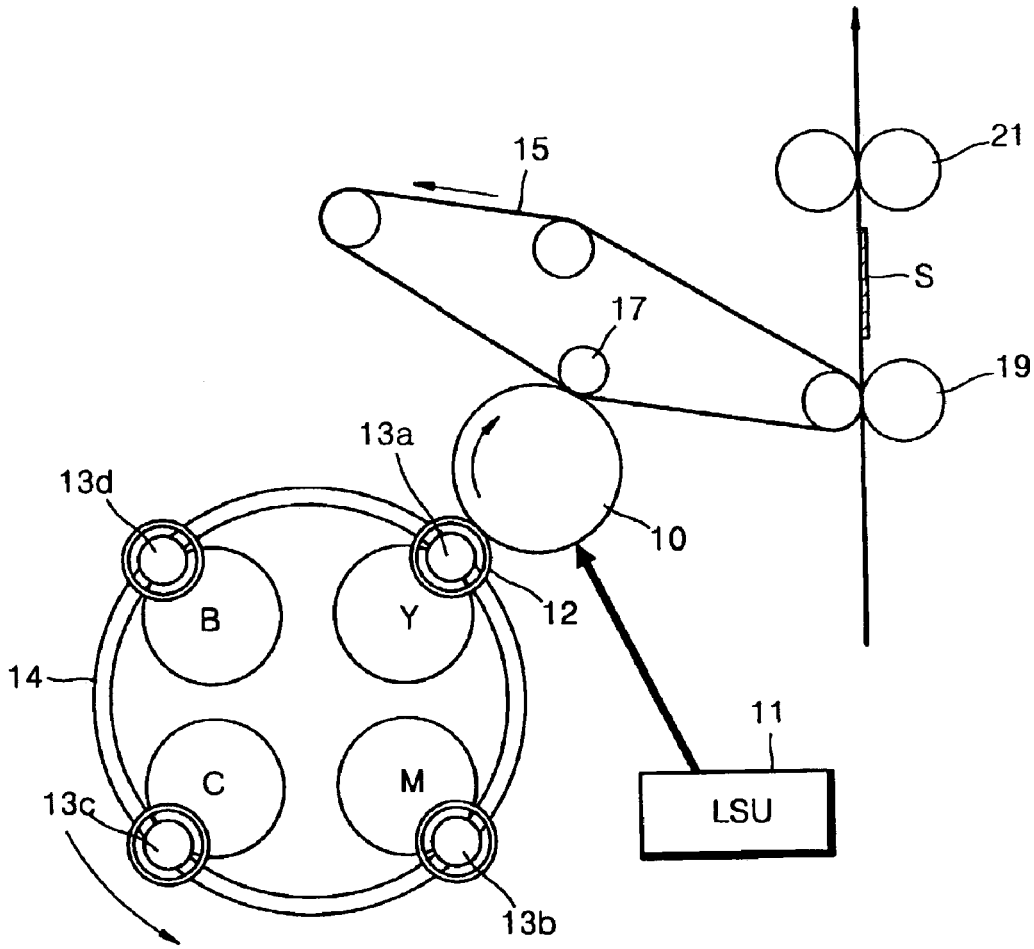
FIG. 1 (PRIOR ART)
FIG. 1 schematically shows a structure of a conventional image forming apparatus.

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

Figure 2:
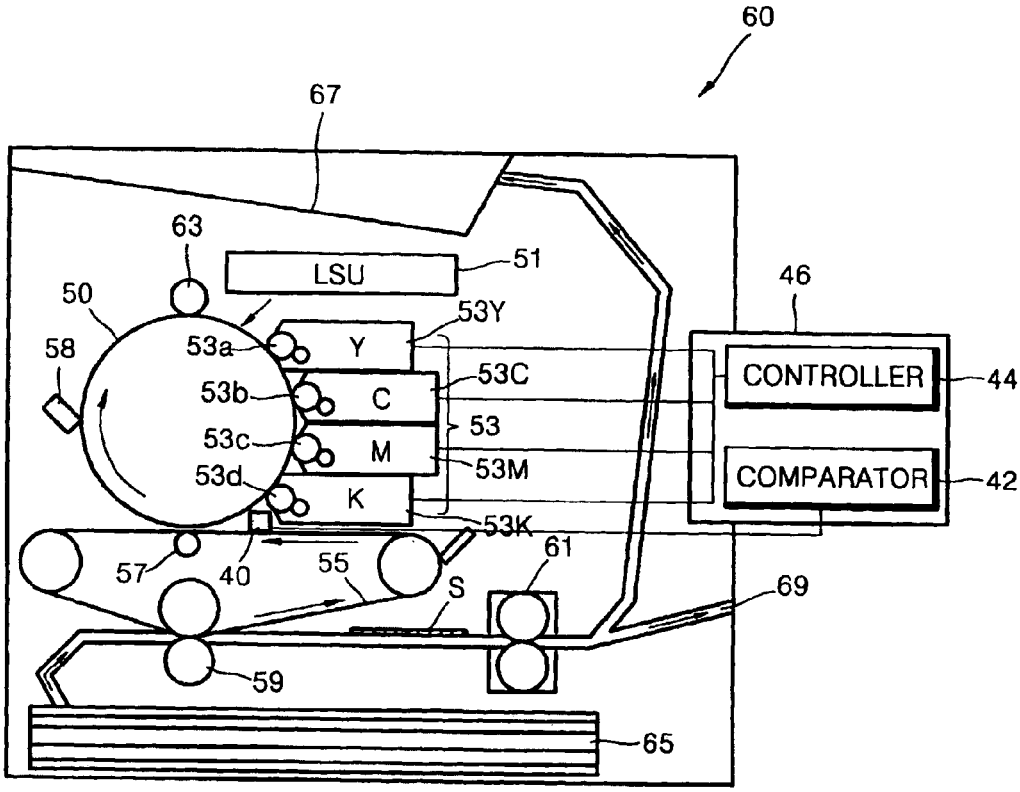
FIG. 2 schematically shows a structure of an image forming apparatus according to an embodiment of the present invention.

FIG. 2 schematically shows a structure of an image forming apparatus 60 according to an embodiment of the present invention. Referring to FIG. 2, the image forming apparatus 60 includes a photosensitive body 50, a charger 63 which charges a surface of the photosensitive body 50 to increase a surface potential of the photosensitive body 50 to a charging potential, a laser scanning unit (LSU) 51 which radiates light onto the surface of the photosensitive body 50 increased to the charging potential by the charger 63 in response to an input signal and reduces the surface potential of the photosensitive body 50 to an exposing potential to form an electrostatic latent image corresponding to an image, a developing unit 53 which develops the electrostatic latent image by supplying a developing agent, which is increased to a developing potential, to the surface of the photosensitive body 50, a surface potential measuring unit 40 which measures the surface potential before and after the photosensitive body 50 is developed by the developing unit 53, a cleaner 58 which removes the developing agent from the photosensitive body 50 after the image is transferred, and an eraser (not shown) which erases the surface potential of the photosensitive body 50.

A development voltage adjuster 46 is connected to the surface potential measuring unit 40. The development voltage adjuster 46 includes a comparator 42 which receives surface potential information transmitted by the surface potential measuring unit 40 before and after a development operation, compares two surface potentials with each other, and calculates a deviation between the two surface potentials, and a controller 44 which transmits a signal used to control the developing unit 53 by setting a predetermined development voltage value based on the deviation calculated by the comparator 42.

The image forming apparatus 60 further includes an intermediate transfer belt 55 which rotates along an endless track and moves the image to a sheet of paper S from the photosensitive body 50, a first transfer roller 57 which transfers a developed image onto the intermediate transfer belt 55 from the photosensitive body 50, a second transfer roller 59 which transfers the image on the intermediate transfer belt 55 onto the paper S, and a fusing unit 61 fixing the image on the paper S. Here, reference numeral 65 denotes a paper cassette which feeds the paper S, and reference numerals 67 and 69 each denote a paper ejecting tray.

The developing unit 53 is divided into four developing units 53Y, 53C, 53M, and 53K which supply developing agents having four colors, such as yellow (Y), cyan (C), magenta (M), and black (K). The respective developing units 53Y, 53C, 53M, and 53K include developing rollers 53*a*, 53*b*, 53*c*, and 53*d*, each of which supplies its developing agent to the photosensitive body 50.

Figure 3:
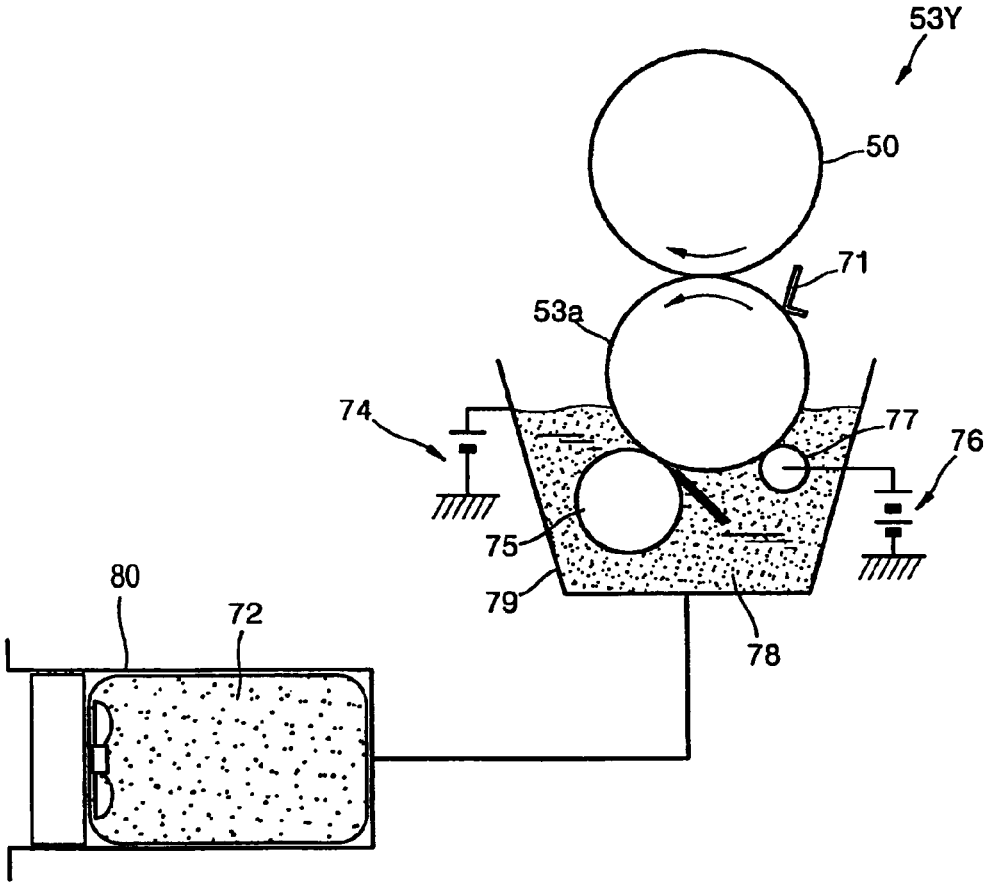
FIG. 3 schematically shows a developing unit of the image forming apparatus shown in FIG. 2.

FIG. 3 schematically shows a developing unit 53Y of the image forming apparatus 60 of FIG. 2. The developing unit 53Y of the image forming apparatus 60 includes a developing agent supplying unit 79 containing a high-concentration developing agent 78, a developing roller 53*a* having a half portion dipped in the developing agent 78 and rotating in a direction of an arrow to hold toner particles attached by a depositing roller 77, a depositing roller 77 which is dipped in the developing agent 78 in the developing agent supplying unit 79 and contacts the developing roller

53*a* or supplies the developing agent 78 to the developing roller 53*a* while forming a developing gap with the developing roller 53*a*, a metering blade 71 which pressurizes the developing roller 53*a* at a predetermined pressure and regulates a thickness of the developing agent attached onto the developing roller 53*a*, and a cleaning roller 75 which contacts the developing roller 53*a*, rotates in the same direction, and cleans the undeveloped developing agent 78. Here, a gap ring (not shown) is inserted around the developing roller 53*a* such that a gap between the developing roller 53*a* and the photosensitive body 50 can be maintained.

Also, the developing unit 53 of the image forming apparatus 60 includes a cartridge 80 containing a developing agent 72 to be supplied to the developing agent supplying unit 79, a first power supply unit 76 which supplies a predetermined deposit voltage to the depositing roller 77, and a second power supply unit 74 which supplies a predetermined development voltage to the developing roller 53*a*.

A DC or AC development voltage is supplied to the developing rollers 53*a*, 53*b*, 53*c*, and 53*d*, such that particles of the developing agent 72 attached onto the developing rollers 53*a*, 53*b*, 53*c*, and 53*d* are increased to the developing potential.

The surface potential measuring unit 40, that is, a surface potential sensor, detects a variation of the surface potential of the photosensitive body 50 before the development voltage is supplied to the developing rollers 53*a*, 53*b*, 53*c*, and 53*d* in a state where a charging voltage is applied to the charger 63 during an initial warm up operation where the development operation is not performed, and detects the variation of the surface potential of the photosensitive body 50 after the development voltage is supplied to the developing rollers 53*a*, 53*b*, 53*c*, and 53*d*, and determines whether a leakage of the development voltage supplied to the developing rollers 53*a*, 53*b*, 53*c*, and 53*d* occurs.

Figure 4:
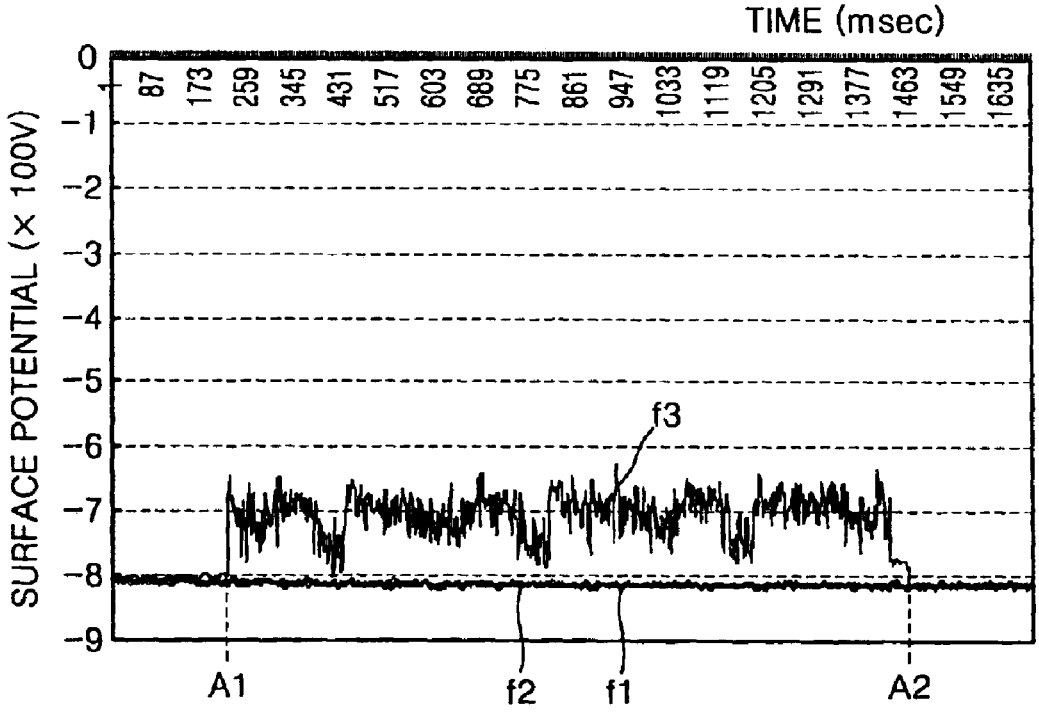
FIG. 4 shows a graph illustrating a variation in surface potentials of a photosensitive body versus time in the image forming apparatus shown in FIG. 2.

FIG. 4 shows a graph illustrating the variation of the surface potential of the photosensitive body 50 versus time. Referring to FIG. 4, f1 represents the variation in the surface potential of the photosensitive body 50 when the development voltage is not applied to the developing unit 53, f2 represents another variation of the surface potential of the photosensitive body 50 when the development voltage is applied to the developing unit 53, and the leakage of the development voltage does not occur, and f3 represents another variation in the surface potential of the photosensitive body 50 when the development voltage is applied to the developing unit 53 and the leakage of the development voltage occurs.

When the leakage of the development voltage occurs, there is a variation of 100 V in the surface potential of the photosensitive body in a region between A1 and A2.

Figure 5:
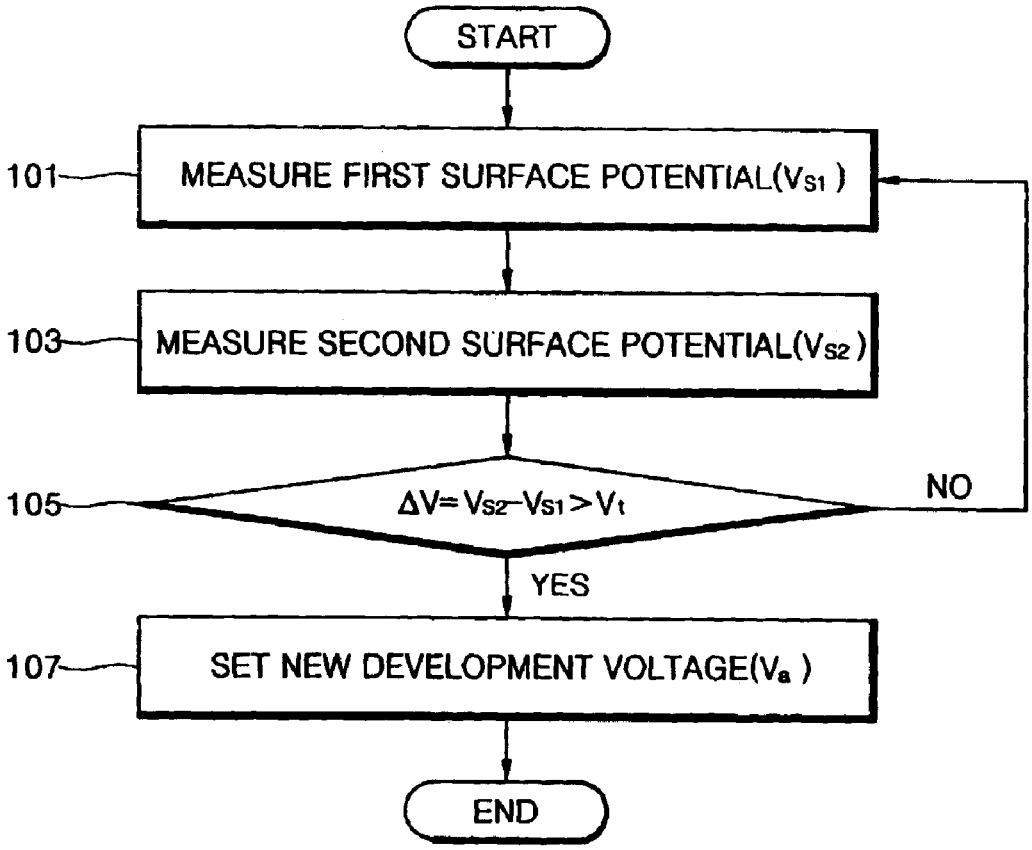
FIG. 5 shows a flow chart illustrating a method of controlling a development voltage in the image forming apparatus shown in FIG. 2.

FIG. 5 shows a flow chart illustrating a method of controlling a development voltage in the image forming apparatus 60 of FIG. 2. The method of controlling the development voltage uses the surface potential measuring unit 40 and the development voltage adjuster 46 of the image forming apparatus 60 of FIG. 2.

In order to control the development voltage, first, a first surface potential Vs1 of the photosensitive body 50 before the development voltage is supplied to the developing unit 53, is measured using the surface potential measuring unit in operation 101. After the development voltage is supplied to the developing unit 53, and charging, exposure, and development operations are performed, a second surface potential Vs2 of the photosensitive body 50 is measured in operation 103. A deviation ΔV between the first surface potential Vs1 and the second surface potential Vs2 is obtained by the following Equation 1 and is compared with a reference value Vt in operation 105. If the deviation ΔV is larger than the reference value Vt, a new development voltage Vd is set, and if the deviation ΔV is not larger than the reference value Vt in operation 107, operation 101 is repeated.

$$\Delta V = V_{s2} - V_{s1}$$

Here, the reference value Vt may be set to a value of about 80–100 V as shown in FIG. 4, and the new development voltage Vd may be set to be smaller than an existing development voltage, that is, to the deviation ΔV.

In the above-mentioned image forming apparatus and the method of controlling the development voltage according to the present invention, the leakage of the development voltage is compensated, such that formation of spots occurring when the electrostatic latent image is developed on the photosensitive body, and an excessive increase in an image concentration are prevented, thereby providing a good image quality.

As described above, in the image forming apparatus and the method of controlling the development voltage, the surface potential measuring unit is simply installed on the surface of the photosensitive body, such that the leakage of the development voltage is detected, the development voltage is effectively controlled, thereby providing the good image quality.

While this invention has been particularly shown and described with reference to a preferred embodiment thereof, it will be understood by those skilled in the art that various changes in form and details may be made therein without departing from the spirit and scope of the invention as defined by the appended claims and equivalents thereof.

What is claimed is:

1. An image forming apparatus comprising:

a photosensitive body;

a charger which charges the photosensitive body;

a laser scanning unit (LSU) which forms an electrostatic latent image by radiating light onto the photosensitive body;

a developing unit which develops the electrostatic latent image by supplying a developing agent to the photosensitive body to form an image;

a transfer unit which transfers the developed image onto a sheet of paper;

a surface potential measuring unit disposed on a surface of the photosensitive body between the developing unit and the transfer unit to measure first and second surface potentials of the photosensitive body before and after a development voltage is supplied to the developing unit, respectively;

a comparator which compares the first surface potential of the photosensitive body with the second surface potential of the photosensitive body to calculate a deviation between the first and second surface potentials; and a controller which sets a new development voltage to be supplied to the developing unit and controls the developing unit if the deviation is larger than a reference value.

2. The apparatus of claim 1, wherein the developing unit comprises:

a developing roller which supplies a developing agent to the photosensitive body; and a gap ring which is inserted around the developing roller so that a gap between the developing roller and the surface of the photosensitive body is maintained.

3. The apparatus of claim 1, wherein the reference value is between 80 and 100 V inclusive.

4. A method of controlling a development voltage supplied to a developing unit of an image forming apparatus, the method comprising:

measuring a first surface potential of the photosensitive body before the development voltage is supplied to the developing unit;

measuring a second surface potential of the photosensitive body after the development voltage is supplied to the developing unit; and upon determining that a deviation between the first surface potential and the second surface potential is larger than a reference value, controlling the developing unit by setting a new development voltage, and upon determining that the deviation is not larger than the reference value, repeating the measuring of the first and second surface potentials and controlling the developing unit.

5. The method of claim 4, wherein the controlling of the developing unit comprises:

setting the new development voltage to be smaller than one of the development voltage supplied to the developing unit in measuring the second surface potential and the deviation.

6. The method of claim 4, wherein the developing unit comprises:

a developing roller which supplies a developing agent to the photosensitive body; and a gap ring which is inserted around the developing roller so that a gap between the developing roller and the surface of the photosensitive body is maintained.

7. The method of claim 4, wherein the reference value is between 80 and 100 V inclusive.

8. An apparatus for controlling a development voltage supplied to a developing unit in an image forming apparatus, comprising:

a surface measuring unit measuring a first surface potential of the photosensitive body before the development voltage is supplied to the developing unit, and a second surface potential of the photosensitive body after the development voltage is supplied to the developing unit; and a development voltage adjuster generating the development voltage according to the first and second potentials.

9. The apparatus of claim 8, wherein the development voltage adjuster compares the first surface potential with the second surface potential and adjusts the development voltage according to a result of the comparison.

10. The apparatus of claim 8, wherein the development voltage adjuster comprises:

a comparator comparing the first surface potential with the second surface potential to generate a deviation; and a controller adjusting the controlling the development voltage according to the deviation.

11. The apparatus of claim 10, wherein the development voltage adjuster comprises a second comparator comparing the deviation with a reference value to generate a comparison result, and the controller adjusts the development voltage according to the comparison result of the second comparator.

12. The apparatus of claim 10, wherein the development voltage adjuster adjusts the development voltage when the deviation is larger than a reference value.

13. The apparatus of claim 10, wherein the development voltage is a predetermined value, and the development voltage adjuster generates the development voltage when the deviation is smaller than a reference value.

14. The apparatus of claim 10, wherein the development voltage is a predetermined value, and the development voltage adjuster does not change the development voltage when the deviation is smaller than a reference value.

15. The apparatus of claim 10, wherein the development voltage adjuster generates a second development voltage different from the development voltage when a deviation between the first and second surface potentials is larger than a reference value.

16. The apparatus of claim 15, wherein the development voltage adjuster generates the second development voltage smaller than the development voltage.

17. The apparatus of claim 15, wherein the development voltage adjuster generates the second development voltage smaller than the deviation.

18. The apparatus of claim 10, wherein the development voltage adjuster generates a second development voltage smaller than the development voltage according to the first and second potentials.

19. A method of controlling a development voltage supplied to a developing unit in an image forming apparatus, the method comprising:

measuring a first surface potential of the photosensitive body before the development voltage is supplied to the developing unit, and a second surface potential of the photosensitive body after the development voltage is supplied to the developing unit; and generating the development voltage according to the first and second potentials.

20. The method of claim 19, wherein the generating of the development voltage comprises:

generating a second development voltage when a deviation between the first and second surface potentials is larger than a reference value.

21. The method of claim 19, wherein the generating of the development voltage comprises:

generating a second development voltage different from the development voltage when a deviation between the first and second surface potentials is larger than a reference value.

22. The method of claim 19, wherein the generating of the development voltage comprises:

generating a second development voltage smaller than one of the second surface potential and a deviation between the first and second surface potentials when a deviation between the first and second surface potentials is larger than a reference value.

* * * * *